US007934285B2

(12) United States Patent
Nottingham et al.

(10) Patent No.: US 7,934,285 B2
(45) Date of Patent: May 3, 2011

(54) MULTIFUNCTIONAL SHOE CARE APPARATUS

(75) Inventors: John Nottingham, Bratenahl, OH (US); John Spirk, Gates Mills, OH (US); Trevor Jackson, Kirtland, OH (US); Patrick Brown, Mantua, OH (US); Doug Whitner, Medina, OH (US); Timothy Callahan, Bentleyville, OH (US)

(73) Assignee: Boxwood Industries, Cleveland, OH (US)

( * ) Notice: Subject to any disclaimer, the term of this patent is extended or adjusted under 35 U.S.C. 154(b) by 79 days.

(21) Appl. No.: 10/939,774

(22) Filed: Sep. 13, 2004

(65) Prior Publication Data

US 2006/0053573 A1 Mar. 16, 2006

(51) Int. Cl.
*A47L 23/02* (2006.01)

(52) U.S. Cl. ..... 15/36; 15/97.2; 15/34; 15/30

(58) Field of Classification Search ..... 15/4, 23, 15/28, 34, 36, 97.2
See application file for complete search history.

(56) References Cited

U.S. PATENT DOCUMENTS

| | | | | |
|---|---|---|---|---|
| 2,014,626 | A * | 9/1935 | Moorhead | 15/98 |
| 3,574,876 | A | 4/1971 | Cohen | |
| 3,742,545 | A | 7/1973 | Kravitz | |
| 3,777,328 | A | 12/1973 | Kaplan | |
| 3,806,260 | A | 4/1974 | Miller | |
| 4,008,504 | A | 2/1977 | Ou | |
| 4,077,725 | A | 3/1978 | Slautterback | |
| 4,158,246 | A * | 6/1979 | Meadows et al. | 15/28 |
| 4,479,516 | A | 10/1984 | Hunter | |
| 4,512,053 | A | 4/1985 | Horak et al. | |
| 4,535,499 | A | 8/1985 | Cho | |
| 4,595,850 | A | 6/1986 | Woog | |
| D286,706 | S | 11/1986 | McCloskey | |
| D289,109 | S | 4/1987 | Buecheler et al. | |
| D300,185 | S | 3/1989 | Suzuki | |
| D301,398 | S | 6/1989 | Cheung | |
| 4,916,770 | A | 4/1990 | Matsumoto | |
| 5,007,754 | A | 4/1991 | Zierhut | |
| D321,596 | S | 11/1991 | Zierhut | |
| 5,188,472 | A | 2/1993 | Sgro | |
| D352,828 | S | 11/1994 | Chen | |
| 5,446,939 | A | 9/1995 | Park | |

(Continued)

FOREIGN PATENT DOCUMENTS

CA 1077438 5/1980

(Continued)

OTHER PUBLICATIONS

Photographic Images of Sunbeam product with two heads that rotate at the same speed; no product literature available.

(Continued)

*Primary Examiner* — Shay L Karls
(74) *Attorney, Agent, or Firm* — Calfee Halter & Griswold LLP

(57) ABSTRACT

The present invention relates to an electric-powered, shoe care apparatus adapted for one-handed operation by a user. The shoe care apparatus is adapted to receive two removable and replaceable heads; a first head is for low-speed application of polish or cleaning material, and a second head is for high-speed polishing or buffing. In some embodiments of the invention, the two heads are driven simultaneously at these two different respective speeds. In alternate embodiments, the two heads are driven separately at these two different respective speeds.

37 Claims, 6 Drawing Sheets

U.S. PATENT DOCUMENTS

| | | | |
|---|---|---|---|
| 5,551,114 | A | 9/1996 | Lee |
| 5,596,785 | A | 1/1997 | Park |
| 5,680,666 | A | 10/1997 | Ra |
| 5,865,554 | A | 2/1999 | Lin |
| 6,264,539 | B1 | 7/2001 | Chen |
| D473,023 | S | 4/2003 | Lausenhammer |
| D492,488 | S | 7/2004 | Har |

FOREIGN PATENT DOCUMENTS

| | | | |
|---|---|---|---|
| CN | 85201121 | U | 5/1986 |
| CN | 85203005 | U | 7/1986 |
| CN | 85205624 | U | 9/1986 |
| CN | 85202674 | U | 11/1986 |
| CN | 8620062 | | 12/1986 |
| CN | 86202659 | U | 8/1987 |
| CN | 86210366 | U | 8/1987 |
| CN | 86201666 | U | 10/1987 |
| CN | 86209424 | U | 12/1987 |
| CN | 87203606 | U | 1/1988 |
| CN | 88201248 | U | 10/1988 |
| CN | 2030819 | U | 1/1989 |
| CN | 2040731 | | 7/1989 |
| CN | 2055359 | U | 4/1990 |
| CN | 2056576 | U | 5/1990 |
| CN | 2058321 | U | 6/1990 |
| CN | 2073729 | U | 3/1991 |
| CN | 2080822 | U | 7/1991 |
| CN | 2085619 | U | 10/1991 |
| CN | 2089786 | U | 12/1991 |
| CN | 2102714 | U | 4/1992 |
| CN | 2113741 | U | 8/1992 |
| CN | 2115762 | U | 9/1992 |
| CN | 2115763 | U | 9/1992 |
| CN | 2119194 | U | 10/1992 |
| CN | 2119886 | U | 10/1992 |
| CN | 2120545 | U | 11/1992 |
| CN | 2130494 | Y | 4/1993 |
| CN | 2138962 | Y | 7/1993 |
| CN | 2139794 | Y | 8/1993 |
| CN | 2143095 | Y | 10/1993 |
| CN | 2148527 | Y | 12/1993 |
| CN | 2151714 | | 1/1994 |
| CN | 2153274 | Y | 1/1994 |
| CN | 2155808 | Y | 2/1994 |
| CN | 2155809 | Y | 2/1994 |
| CN | 2157700 | Y | 3/1994 |
| CN | 2160250 | Y | 4/1994 |
| CN | 2163571 | Y | 5/1994 |
| CN | 2209949 | | 10/1994 |
| CN | 2193077 | Y | 3/1995 |
| CN | 2193715 | Y | 4/1995 |
| CN | 2196459 | | 5/1995 |
| CN | 2204575 | Y | 8/1995 |
| CN | 2209948 | Y | 10/1995 |
| CN | 2217956 | Y | 1/1996 |
| CN | 2224538 | Y | 4/1996 |
| CN | 2236284 | Y | 10/1996 |
| CN | 2240956 | Y | 11/1996 |
| CN | 2250111 | Y | 3/1997 |
| CN | 2250112 | Y | 3/1997 |
| CN | 2255814 | | 6/1997 |
| CN | 2299582 | Y | 12/1998 |
| CN | 2300369 | Y | 12/1998 |
| CN | 2313537 | Y | 4/1999 |
| CN | 2340363 | Y | 9/1999 |
| CN | 2355633 | Y | 12/1999 |
| CN | 2388917 | Y | 7/2000 |
| CN | 2449653 | U | 11/2000 |
| CN | 2460034 | Y | 1/2001 |
| CN | 2490973 | U | 5/2001 |
| CN | 2449653 | | 9/2001 |
| CN | 2452449 | | 10/2001 |
| CN | 2513513 | | 10/2002 |
| CN | 2524664 | | 12/2002 |
| CN | 2524664 | Y | 12/2002 |
| CN | 2587343 | Y | 12/2002 |
| CN | 2542202 | Y | 4/2003 |
| CN | 2574584 | Y | 9/2003 |
| CN | 2579334 | Y | 10/2003 |
| CN | 2587343 | U | 11/2003 |
| CN | 2587343 | Y | 11/2003 |
| JP | 61272027 | A2 | 12/1986 |
| JP | 9-98935 | A2 | 4/1997 |
| JP | 22153324 | A2 | 5/2002 |
| KR | 9610946 | B1 | 8/1996 |
| WO | WO 85/02992 | | 7/1995 |
| WO | WO 02/17767 | | 3/2002 |

OTHER PUBLICATIONS

Seven pages, printout from ebay, 1 shoe shine box/2 electric polisher, item 5703804688.

Two pages, printout for Turbo Polish Shoe Shine System from asseenontvandmore.com.

Four page printout from ebay containing search results of a shoe polisher.

Two page printout of Automatic Shoe Polisher—EOSB Gift Boutique, Stock # ATRG20800.

Five pages from George's Shoe Store website for electric shoe buffers, 2004.

Two page, printout from wonderfulbuys.com website for Shoe-Shine Express.

Ten pages, printout from asseenontv.com Automatic Shoe Polisher.

Web printout, one page, Giftwagon Shoe Shine Kit.

Delphion Search based on search query: ((shoe*) and (shine* or polish* or buff* or cleaner or cleaning device or brush* or care)).

Three pages, printout from website shoepolishers.com, Shoe Polishers—Electric Shoes Buffers.

* cited by examiner

MULTIFUNCTIONAL SHOE CARE APPARATUS

TECHNICAL FIELD

The present invention relates generally to an electric shoe care apparatus. More particularly, the present invention relates to an electric shoe care apparatus that may be held in one hand, and is useful for automatically treating shoes with cleaning and polishing agents, and for automatically buffing and shining shoes.

BACKGROUND OF THE INVENTION

Polishing is an activity which is useful to maintain the appearance and condition of footwear, and other accessories such as belts, purses, and the like. These objects, whether made from fabric, leather, or similar materials, often become dirty or dull as a result of use. Various implements have been developed for applying treatment agents to the surfaces of such objects to clean or enhance their finish, and for polishing after treatment. In many cases, more than one implement is required to complete the polishing process; for example, when polishing shoes, it is often necessary to use one implement for applying polish to the shoes, and another implement to buff the polish in order to achieve the desired shine. Moreover, such implements generally require both hands, and use of them often results in transfer of treatment agent to the hands of the user. Because of the need to use more than one implement, and the mess that is often associated with the process, many users are not inclined to regularly polish their shoes. Accordingly, there is a need for a shoe care apparatus which is multifunctional, can be used with one hand to achieve effective treatment and buffing, and which minimizes the need for the user to come in direct contact with polish and other treatment agents.

SUMMARY OF THE INVENTION

The present invention relates to an electric-powered, shoe care apparatus adapted for one-handed operation by a user. The shoe care apparatus is adapted to receive two removable and replaceable heads; a first head is for low-speed application of polish or cleaning material, and a second head is for high-speed polishing or buffing. In some embodiments of the invention, the two heads are driven simultaneously at these two different respective speeds. In alternate embodiments, the two heads are driven separately at these two different respective speeds.

According to one embodiment of the instant invention, the shoe care apparatus has an elongated handle that extends to a head that has first and second separate shanks. In this embodiment, the shanks are positioned approximately opposite one another, at one end of the elongated handle. Each shank defines an axis of rotation, and is engaged to one or more internal gear arrangements within the device that drive rotation of each shank about its axis of rotation. In some embodiments, the axes of rotation of the shanks are parallel to one another, and are perpendicular to and intersect a central axis that is defined by the elongated handle. In one embodiment, the shanks share the same axis of rotation. In other embodiments, the axis of rotation of at least one shank may be oriented at an angle that is from 95° to 150 relative to the axis of the elongated handle.

The rates of rotation of the shanks are different, and are driven by one or more gear arrangements that are in some embodiments internal to the shoe care apparatus. The gear arrangements are operatively connected to a power source, such as a motor. In some embodiments, reduction gears having a planetary arrangement are used to drive rotation of one or both shanks. In other embodiments, reduction gears having a compound arrangement are used to drive rotation of one or both shanks. In yet other embodiments, combinations of gear arrangements are used, wherein, for example, one shank is driven by a planetary gear arrangement and the other shank is driven by a compound gear arrangement.

The ratios of rates of rotation of the shanks are between 1:2 and 1:100. In some embodiments, the ratios of rates of rotation of the shanks are from 1:3 to 1:5. The rate of rotation of the high-speed shank, in operation, is from 500 to 2000 rpm, and the rate of rotation of the low-speed shank, in operation, is from 0.001 to 400 rpm. The torque, or twisting force, around the high-speed shank, in operation, is from 50 to 250 MilliNewton Meters, and the torque around the low-speed shank, in operation, is from 300 to 600 MilliNewton Meters.

In some embodiments, the low-speed shank and its corresponding head, and the high-speed shank and its corresponding head, respectively, are uniquely keyed such that each shank engages only with its corresponding head, thus preventing the heads from being interchanged between the shanks. In some embodiments, engagement between a head and a shank is achieved by insertion of the shank into a recess in the corresponding head, wherein the shape of the first shank and the recess in its corresponding head is different as compared to the shape of the second shank and the recess in its corresponding head. In other embodiments, other engagement means are used.

When engaged with a shank, each head has an exposed face that is generally planar and perpendicular to the shank axis. In some embodiments, a head face may be disc shaped. In alternate embodiments, a head face may be square, triangular, or oval, or may have a shape that is hemispherical, or conical. In some embodiments, a head may also comprise a lip, skirt, or edge that extends from or is continuous with the generally planar face, and when engaged with a shank, is generally parallel to the shank axis.

In operation, the shoe care apparatus is powered, in some embodiments with internal batteries, to drive rotation of the heads simultaneously about the axes defined by the shanks at different speeds or "rpm" rates, as described above. In some embodiments, each head may be operated at more than one speed setting within the rpm ranges recited for each shank. In some embodiments, the shoe care apparatus also comprises a clutch or other device for alternately engaging and disengaging the gears of each of the shanks, such that the device may be operated to drive only one head at a time, or both heads simultaneously.

Additional features and advantages of the invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention, and together with the description, serve to explain the principles of the invention.

BRIEF DESCRIPTION OF THE DRAWINGS

The present invention may be more readily understood by reference to the following drawings wherein.

DETAILED DESCRIPTION OF THE INVENTION

The present invention will now be described with occasional reference to specific embodiments of the invention. This invention may, however, be embodied in different forms and should not be construed as limited to the embodiments set forth herein. Rather, these embodiments are provided so that this disclosure will fully convey the scope of the invention to those skilled in the art.

Except as otherwise specifically defined herein, all terms used herein have the same meaning as commonly understood by one of ordinary skill in the art to which this invention belongs. The terminology used in the description of the invention herein is for describing particular embodiments only, and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities, properties, and so forth as used in the specification and claims are to be understood as being modified in all instances by the term "about." Accordingly, unless otherwise indicated, the numerical properties set forth in the following specification and claims are approximations that may vary depending on the desired properties sought to be obtained in embodiments of the present invention. Notwithstanding that the numerical ranges and parameters setting forth the broad scope of the invention are approximations, the numerical values to the extent that such are set forth in the specific examples are reported as precisely as possible. Any numerical values, however, inherently contain certain errors necessarily resulting from error found in their respective measurements.

Except as otherwise indicated, the disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

The invention relates to electric shoe care apparatuses of varying constructions for the polishing of various objects, including shoes and boots, and other accessories, such as belts, purses, and the like. The electric shoe care apparatuses are adapted to receive two discrete heads which engage with the electric shoe care apparatus, and in operation, rotate at different ranges of speed. The heads of the electric shoe care apparatuses according to the present invention are, respectively, useful for applying polishing and cleaning agents at relatively low speeds to the surface of objects, and for buffing and shining the surfaces of the objects at relatively high speeds.

Figure 1:
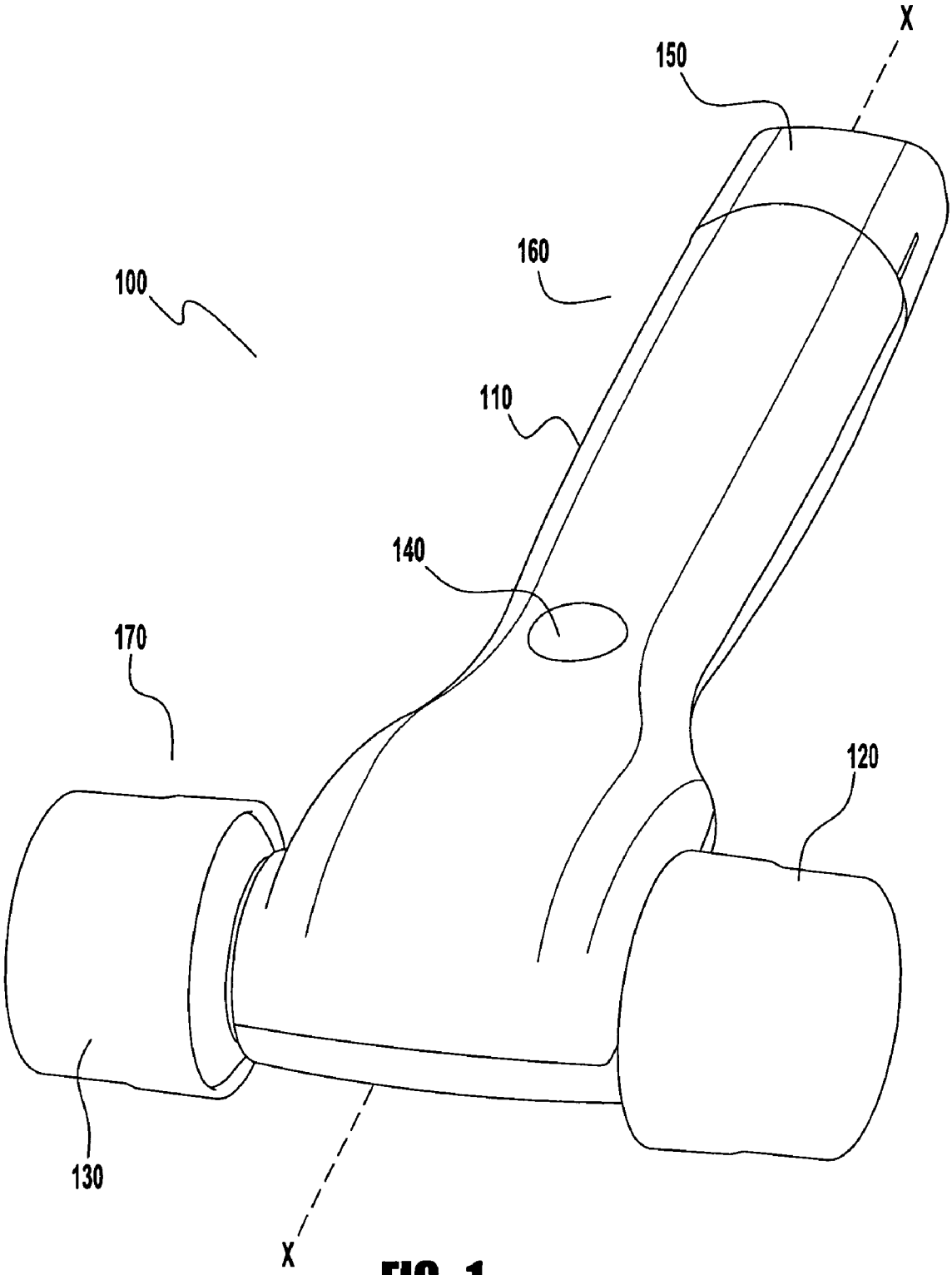
FIG. 1 shows a perspective view of one embodiment of a shoe care apparatus of the present invention.

As representative of the invention, FIG. 1 illustrates a shoe care apparatus 100 in accordance with one embodiment of the invention. As shown in FIG. 1, the shoe care apparatus 100 of the illustrated embodiment generally includes a housing 110, a first head 120, a second head 130, an activation switch 140, and a battery cap 150. In the illustrated embodiment, the shoe care apparatus has an elongated handle portion 160 and a head portion 170, the length of the elongated handle portion 160 defined by a longitudinal axis X. In the illustrated embodiment, the head portion 170 has an axis of symmetry that is defined by the axis X.

Figure 2:
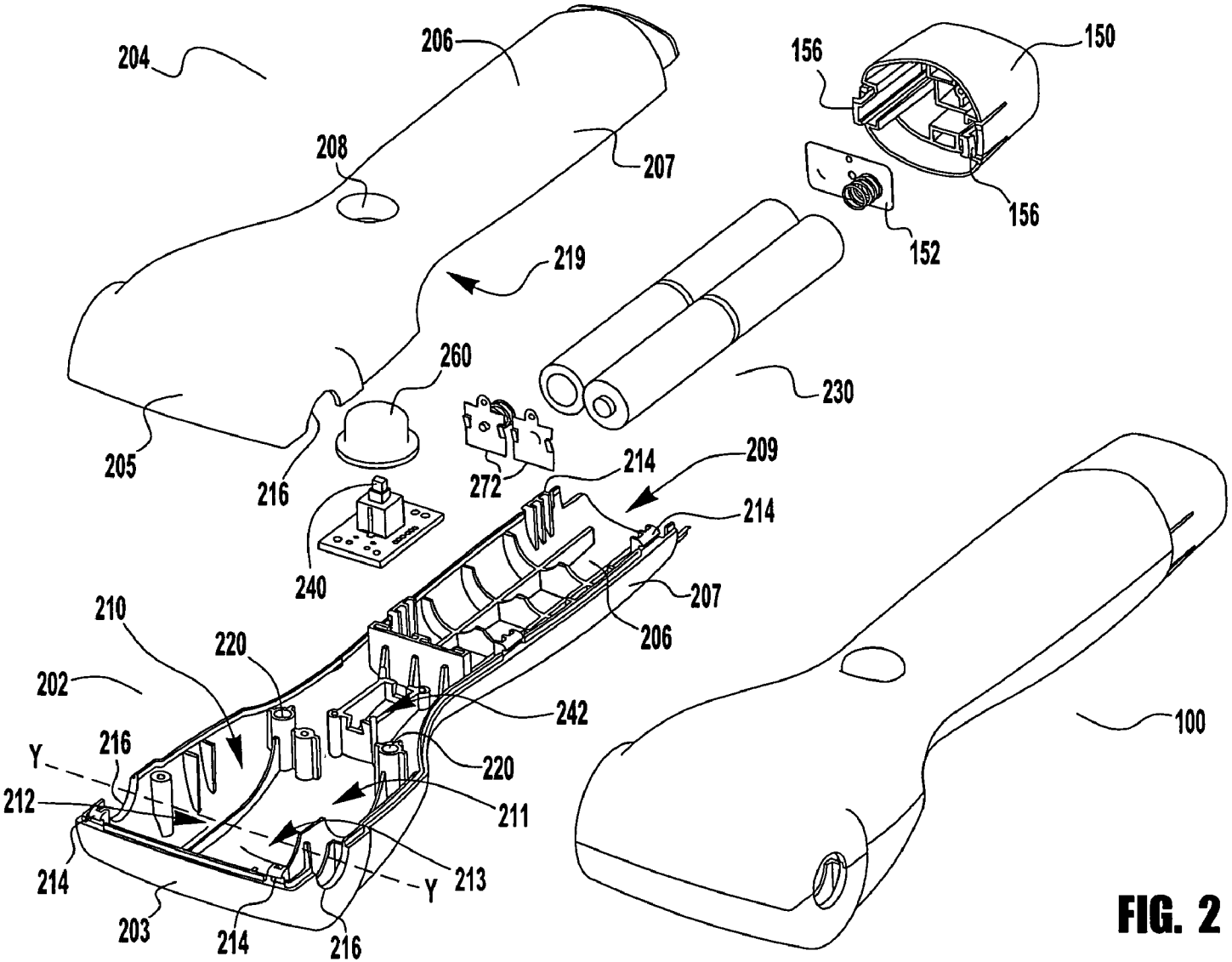
FIG. 2 shows a perspective view of the assembled shoe care apparatus of FIG. 1, and an exploded perspective view of the shoe care apparatus of FIG. 1.

The shoe care apparatus 100 includes a housing 110. As illustrated in FIG. 2, the housing 110 of the shoe care apparatus 100 includes a base 202 and a cover 204. Both the base 202 and the cover 204 are in some embodiments molded from plastic, but other suitable materials can be used. The configurations of the base 202 and cover 204 are adapted to support and enclose other components of the shoe care apparatus 100. In the illustrated embodiment of FIG. 2, the base 202 has a rear face 203, and the cover 204 has a front face 205. Both the base 202 and the cover 204 have a generally flat main wall 206 and a pair of side walls 207 that extend from the main wall to form a partially closed space. In some embodiments, the housing comprises a stabilizer foot (not shown) that elevates the head portion 170 of the shoe care apparatus 100 when it is allowed to rest on a surface. The stabilizer foot ensures that the head portion 170 of the shoe care apparatus 100 is not in direct contact with the support surface so as to reduce the possibility of the heads becoming solid or of soiling the support surface. In alternate embodiments, the support foot is adjustable or retractable so that when the foot is in an open position it supports the shoe care apparatus 100, and when it is in a closed position, it does not support the shoe care apparatus 100. A switch opening 208 is defined within the main wall 206 of the cover 204. The elongated handle portion 160 of both the base 202 and the cover 204 each has a generally C-shaped cross section when viewed from the side.

The side walls 207 of the cover 204 and the base 202 are complimentary with each other. Thus, when the cover 204 and the base 202 are assembled together, the partially closed spaces formed by the side walls 207 of both the base 202 and the cover 204 combine to form one closed space that encloses other components of the hand held shoe care apparatus 100. As illustrated in FIG. 2, the closed space formed within the cover 204 and the base 202 is generally divided into two main compartments, namely, a battery compartment 209, and a drive system compartment 210. The drive system compartment 210 is further divided into an electric motor compartment 211, a gear assembly compartment 212, and a shank mounting compartment 213. In the illustrated embodiment, the cover 204 and the base 202 are secured to each other by inter-engaging tabs 214 and slots (not shown), and are further secured via screws (not shown) inserted through screw holes 220 located in both the base 202 and the cover 204. While the tabs 214, slots, and screw holes 220 are shown in the embodiment of FIG. 2, several other methods of assembling the base 202 and the cover 204 together could be used, such as glue, and different configurations of tabs, slots, screws, other engagement means, and combinations thereof.

In the illustrated embodiment, corresponding side walls of the base 202 and the cover 204 in the elongated handle portion 160 include a contoured indentation 219 that is adapted to ergonomically fit the hand of the user and provide a comfortable grip. The user can grasp the shoe care apparatus firmly and securely without his/her hand slipping along the housing 110. Of course, in alternate embodiments, the shoe care apparatus 100 lacks the feature of a contoured indentation 219, and may comprise other features that enhance the grip and control of the device, such as texturing on the handle portion 160, or other means for improving grip.

In the illustrated embodiment, the shoe care apparatus 100 includes a battery cap 150 that seals the battery compartment 209 of the housing 110 and secures the batteries in place. The illustrated battery cap 150 includes a battery contact 152. The battery cap 150 is in some embodiments molded as one piece out of a suitable material such as plastic. The battery cap 150 is secured to the housing 110 by a plurality of inter-engaging tabs 156 and slots (not shown). However, the battery cap 150 could also be secured to the housing 110 using other engagement or fastening means such as locking slots and grooves, multiple clips, screws, etc. (not shown). In some embodiments, the bottom of the battery cap 150 is rounded (not shown) to prevent the shoe care apparatus 100 from being stood upright on its end on a table or other surface. If the shoe care apparatus were able to stand up on its end, it could be unsteady due to the weight of the head portion 170, and thus prone to damage from falling. Accordingly, a rounded cup shaped battery cap 150 makes the shoe care apparatus 100 incapable of standing on its end, therefore averting the risk of damage. In alternate embodiments the battery cap 150 may have a generally flat bottom.

It should be apparent to one skilled in the art that the space within the housing 110 could be configured differently, and need not include each of the described compartments. For instance, the housing 110 need not include a battery compartment 209 if the batteries 230 or other power source (not shown) are not to be contained within the shoe care apparatus 100. The housing 110 could have many different shapes or configurations, for example it could be a cylindrical shape or a general box-like shape, or more or less elongated (not shown). The housing 110 could alternatively be spherical or hemispherical in shape (not shown) and comprise a handle (not shown) in the form of an integral or separate part. The housing 110 could be made up of two or more separate parts, or it could be molded as one piece out of a suitable material, such as plastic. Likewise, the housing 110 need not include the contoured indentation 219 or battery cap 150.

Figure 3:
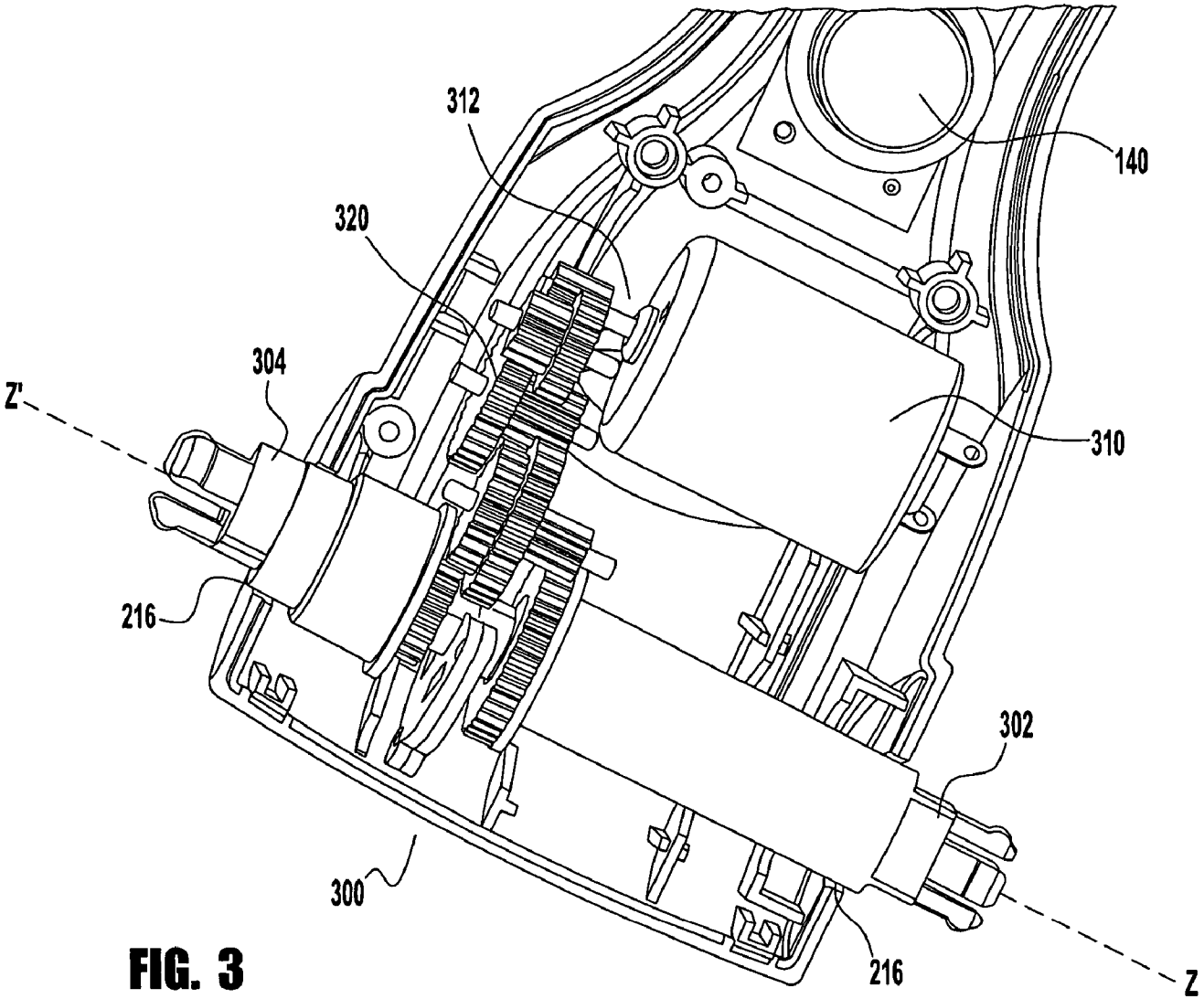
FIG. 3 shows a perspective view of the drive system of the shoe care apparatus of FIG. 1.

In the illustrated embodiment of FIG. 2, the cover 204 and the base 202 each have a shank mounting compartment 213 situated in the head portion 170, the shank mounting compartment 213 being defined by the axis Y, which in the illustrated embodiment is generally perpendicular to the longitudinal axis X about which the head portion 170 is generally symmetrical. Referring to FIG. 3, the shank mounting compartment 213 according to the illustrated embodiment is adapted to contain a first shank 302 and a second shank 304, wherein the shanks are positioned within the shank mounting compartment 213 in substantially semi-circular shank openings 216 located in both the base 202 and the cover 204. Of course, the shank mounting compartment 213 could be configured differently, for example, the shank openings 216 could be positioned differently within one or both of the base 202 and cover 204, or the shank openings 216 could have a different shape.

Referring to the illustrated embodiment in FIG. 3, the shanks 302 and 304 are positioned approximately opposite one another, at one end of the elongated handle portion 160. Each shank 302 and 304 defines a shank axis of rotation, Z and Z', and each shank 302 and 304 is engaged to one or more internal gear arrangements of the drive system 300 that drive rotation of each shank about its axis of rotation. In some embodiments, such as depicted in FIGS. 1-4, the axes of rotation of the shanks 302 and 304 are parallel to one another, and are perpendicular to and intersect the central axis X. In one embodiment according to the present invention, the shanks 302 and 304 share the same axis of rotation, as shown in FIG. 3, where Z=Z'. In other embodiments, the axis of rotation of at least one shank may be oriented at an angle that is from 95° to 15° relative to the axis of the elongated handle, such that the shank axes are not shared and are not parallel (not shown).

The shanks 302 and 304 rotate within the shoe care apparatus 100 to drive the rotation of heads (described below) that are used for applying treatment agents, and for polishing. The rates of rotation of the shanks 302 and 304 are different, and are driven by one or more gear assemblies. Referring to FIG. 3, in some embodiments, both of the shanks 302 and 304 are operatively connected to a single gear assembly 320. In other embodiments, each of the shanks 302 and 304 is operatively connected to a separate gear assembly (not shown). Referring to FIG. 3, the at least one gear assembly 320 is operatively connected to a power source, such as an electric motor 310, as described below.

The ratios of rates of rotation of the shanks 302 and 304 are from 1:2 to 1:100. In some embodiments, the ratios of rates of rotation of the shanks 302 and 304 are from 1:3 to 1:5. Referring to the embodiment illustrated in FIG. 2, the shank 302 located on the left side of the shoe care apparatus 100 is the low-speed shank, and the shank 304 located on the right side of the shoe care apparatus 100 is the high-speed shank. Of course, other shank configurations could be used wherein the low-speed and high-speed shanks are positioned differently relative to one another and the housing of the shoe care apparatus. According to the invention, the high-speed shank rotates at a rate that is relatively greater than the rate of rotation of the low-speed shank.

In some embodiments, each of the shanks rotate in the same direction around the their respective axes, such that when the shoe care apparatus 100 is viewed from either the rear face 203 or the front face 205, both shanks are rotating the same direction relative to the viewed face, but when the shoe care apparatus 100 is viewed in profile along the axis of each shank, one shank is rotating in a clockwise direction and the other shank is rotating in a counter-clockwise direction. According to such embodiments, the direction in which a treatment agent is applied using the low-speed shank will be different from the direction in which the polishing will be achieved by the high-speed shank.

In other embodiments, each of the shanks rotate in opposite directions around their respective axes, such that when the shoe chare apparatus is viewed from either the rear face 203 or the front face 205, the shanks are rotating in opposite directions, but when the shoe care apparatus 100 is viewed in profile along the axis of each shank, both shanks are rotating in the same direction, either clockwise, or counter-clockwise. According to such embodiments, the direction in which a treatment agent is applied using the low-speed shank will be the same as the direction in which the polishing will be achieved by the high-speed shank.

The rate of rotation of the high-speed shank, in operation, is from 500 to 2000 rpm, and the rate of rotation of the low-speed shank, in operation, is from 0.001 to 400 rpm. According to the present invention, the rate of rotation of the high-speed shank, in operation, is 500, 600, 700, 800, 900, 1000, 1100, 1200, 1300, 1400, 1500, 1600, 1700, 1800, 1900, or 2000 rpm. Also according to the present invention, the rate of rotation of the low-speed shank, in operation, is 0.001, 0.010, 0.10, 1, 10, 20, 30, 40, 50, 60, 70, 80, 90, 100, 150, 200, 250, 300, 350, or 400 rpm. In some embodiments, the shoe care apparatus 100 comprises markings (not shown) to enable a user to visualize the relative rates of rotation of each of the heads, thus providing the user with additional visual cues to distinguish the fast moving head from the slower moving head.

As more fully described herein, the torque, or twisting force, around the high-speed shank, in operation, is from 50 to 250 MilliNewton Meters, and the torque around the low-speed shank, in operation, is from 300 to 600 MilliNewton Meters. According to the present invention, the torque around the high-speed shank is 50, 60, 70, 80, 90, 100, 110, 120, 130, 140, 150, 160, 170, 180, 190, 200, 210, 220, 230, 240, or 250 MilliNewton Meters. Also according to the present invention, the torque around the low-speed shank is 300, 310, 320, 330, 340, 350, 360, 370, 380, 390, 400, 410, 420, 440, 450, 460, 470, 480, 490, 500, 510, 521, 530, 540, 550, 560, 570, 580, 590, or 600 MilliNewton Meters.

Referring to FIG. 3, the shoe care apparatus 100 includes at least one gear assembly 320, which are in some embodiments internal to the shoe care apparatus 100. In some embodiments, a gear assembly 320 comprises reduction gears. As used herein in the context of gears, the term "reduction" means gearing that reduces an input speed to a slower output speed. In some embodiments, reduction gears having a planetary arrangement are used to drive rotation of one or both shanks 302 and 304. As used herein, the term "planetary gearset" refers to a gearset in which all of the gears are in one plane, grouped around each other like the planets around the sun. The central gear is called the "sun gear." In mesh with it is a circular grouping of gears, called "planet gears," mounted on a rotating carrier. The planet gears also engage teeth on the inner periphery of the "ring gear." By holding any one of the three gear elements motionless, different ratios can be produced between the other two. In other embodiments, reduction gears having a compound arrangement are used to drive rotation of one or both shanks 302 and 304. As used herein, the term "compound gearset" means a gearset in which two or more gears are fixed on the same shaft. In yet other embodiments, combinations of gear arrangements are used, wherein, for example, one shank is driven by a planetary gear arrangement and the other shank is driven by a compound gear arrangement.

Figure 4:
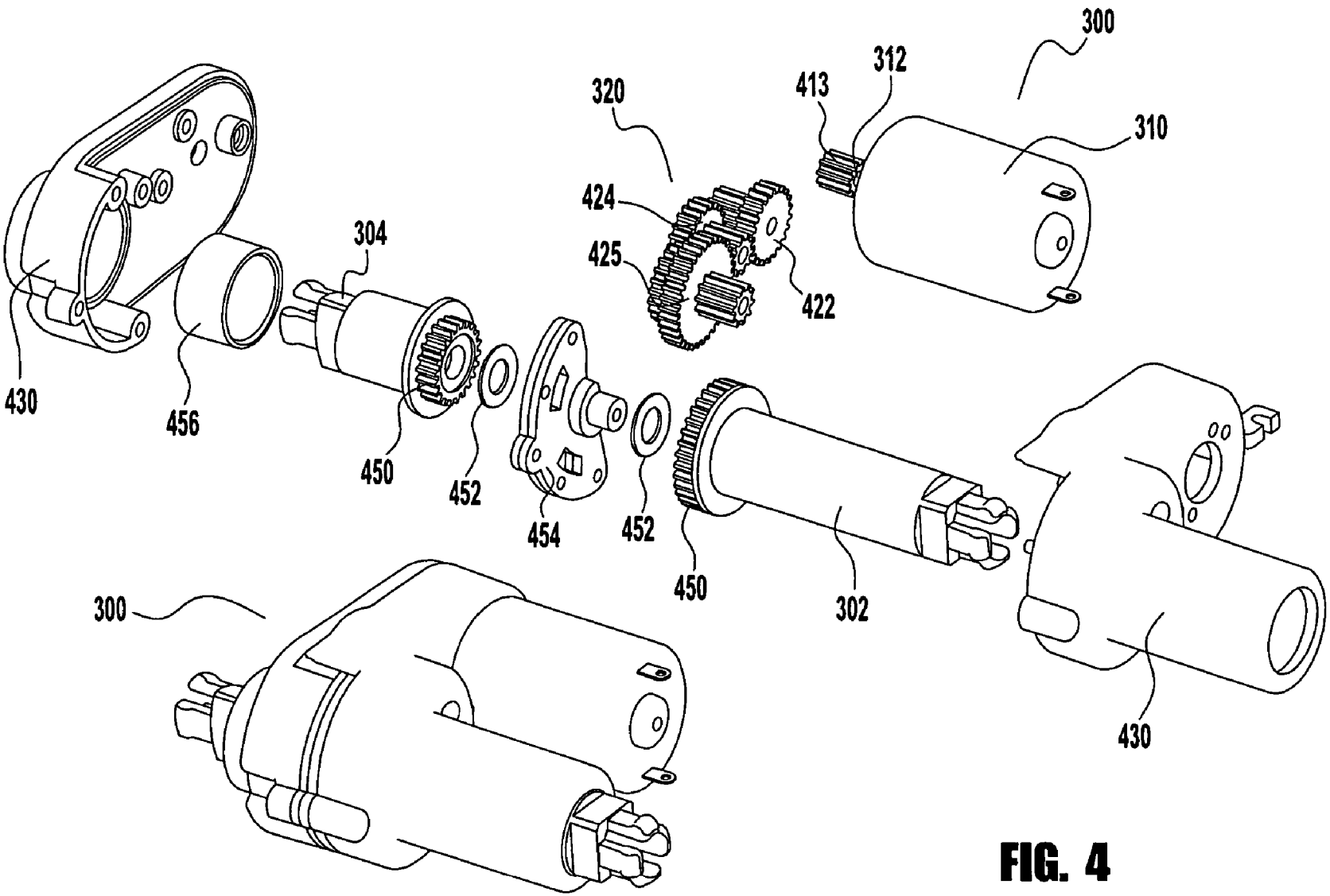
FIG. 4 shows a perspective view of the assembled drive system of FIG. 3, in which the motor is connected to the gear assembly which is enclosed in the gear housing, and the shanks are shown extending from within the gear housing, and an exploded perspective view of the drive system of FIG. 3.

Referring to FIG. 4, the gear assembly 320 of the illustrated embodiment is a compound gear arrangement that includes a main gear 422 mounted for rotation within the gear assembly housing 430, the main gear 422 engaging with a cylindrical gear 413 mounted on the output shaft 312 of the electric motor 310. The gear assembly 320 is supported within the gear assembly compartment 212 of the housing 110. In the illustrated embodiment of FIG. 3, the gear assembly 320 is fashioned primarily out of plastic, but other suitable materials, such as metal, or combinations of materials, could be used. In some embodiments, the gear assembly 320 comprises one or more additional gears. Referring to FIG. 4, two additional step gears 424 and 425 are shown in operative connection with the main gear 422.

Referring to FIG. 3, the shoe care apparatus 100 also includes an electric motor 310. The electric motor 310 is supported and enclosed within the electric motor compartment 211 of the housing 110. The electric motor 310 has a generally cylindrically shape and a protruding output shaft 312 that rotates when the motor is activated. Multiple types and configurations of electrical motors may be used with the shoe care apparatus 100 to achieve the desired combination of treatment and polishing effectiveness, and manufacturing cost savings. Accordingly, various combinations of motor cage sizes, wire sizes, number of wire winds, and magnet types may be used according to the present invention. The electric motor 310 rotates its output shaft 312 at between 10,000 revolutions per minute to 25,000 revolutions per minute when no load is placed on the electric motor 310. According to the present invention, the electric motor rotates its output shaft 312 at 10000, 10250, 10500, 10750, 11000, 11250, 11500, 11750, 12000, 12250, 12500, 12750, 13000, 13250, 13500, 13750, 14000, 14250, 14500, 14750, 15000, 15250, 15500, 15750, 16000, 16250, 16500, 16750, 17000, 17250, 17500, 17750, 18000, 18250, 18500, 18750, 19000, 19250, 19500, 19750, 20000, 20250, 20500, 20750, 21000, 21250, 21500, 30250, 22000, 22250, 22500, 22750, 23000, 23250, 23500, 23750, 24000, 24250, 24500, 24750, or 25000 revolutions per minute when no load is placed on the electric motor 310. The torque of the output shaft 312 of the electric motor 310 is from 4 to 25 MilliNewton Meters. According to the present invention, the electric motor torque 310 is 4, 5, 6, 7, 8, 9, 10, 11, 12, 13, 14, 15, 16, 17, 18, 19, 20, 21, 22, 23, 24, 25 MilliNewton Meters, or fractions thereof.

When the electric motor 310 is activated and the output shaft 312 of the electric motor 310 rotates, the cylindrical gear 413 mounted on the output shaft 312 rotates and drives the main gear 422 of the gear assembly 320. The main gear 422 is mechanically connected with the gear assembly receiver portion 450 of at least one shank. The main gear 422, together with the gear assembly receiver portion 450 of at least one shank, transfer the rotational motion of the cylindrical gear 413 mounted on the output shaft 312 of the electric motor 310 to the at least one shank. Accordingly, as the cylindrical gear 413 turns, the main gear 422 of the gear assembly 320 turns; as the main gear 422 turns, each of the one or more additional step gears (such as the two gears 424 and 425 shown in FIG. 4) are driven to rotate, and in turn, the gear assembly receiver portion 450 of at least one shank is driven to rotate. The number, sizes, and ratios of the gears in the gear assembly 320 influence whether the rate of rotation of at least one shank is the same as or different from the rate of rotation of the output shaft 312 of the electric motor 310. Good results have been obtained using three step gears according to the embodiment illustrated in FIG. 3 and FIG. 4, where the step gear 425 engages with a gear receive portion 450 on a first shank 302 and also with a gear receiver portion 450 on a second shank 304, and where the gear ratios for the low-speed shank are 58.32:1 and the ratios for the high-speed shank are 14.58:1. In some embodiments, the gear assembly comprises one or more shank washers 452, one or more shank supports 454, and one or more bushings 456, as shown in FIG. 4., which serve to support and aid in smooth rotation of the shanks within the gear assembly 320. Of course, other combinations of gears and other gear ratios can be used with a variety of gear assemblies together with a variety of different motors having selected motor specifications, polish head dimensions, and power source output, wherein the combination of such factors provides torque and rotational speeds for each head in the ranges recited herein.

In one embodiment of the shoe care apparatus 100 illustrated in FIG. 3, the electric motor 310 operates on 9 volts of power, and generally rotates its output shaft 312 at a rate of 17,000 revolutions per minute. Good results have been obtained with an electric motor that has a speed of approximately 14,000 rpm at no load, and produces a minimum torque of 4.236 MilliNewton Meters at maximum efficiency (with a speed of approximately 12,000 rpm) when no load is placed on the electric motor 310, with a torque of 24.864 MilliNewton Meters at maximum torque, and with a torque of 12.831 MilliNewton Meters at maximum power (at a speed of approximately 7000 rpm). The torque, or twisting force, around the high-speed shank 304, in operation, is approximately 114 MilliNewton Meters, and the torque around the low-speed shank 302, in operation, is approximately 455 MilliNewton Meters. It should be apparent to those skilled in the art, that various configurations of gear assemblies, and various electric motors could be used, and the present invention is not limited to the disclosed gear assemblies, or electric motor outputs. The configuration of the motor of the illustrated embodiment was chosen because good results have been obtained in achieving the desired combination of effectiveness and manufacturing cost.

Figure 5:
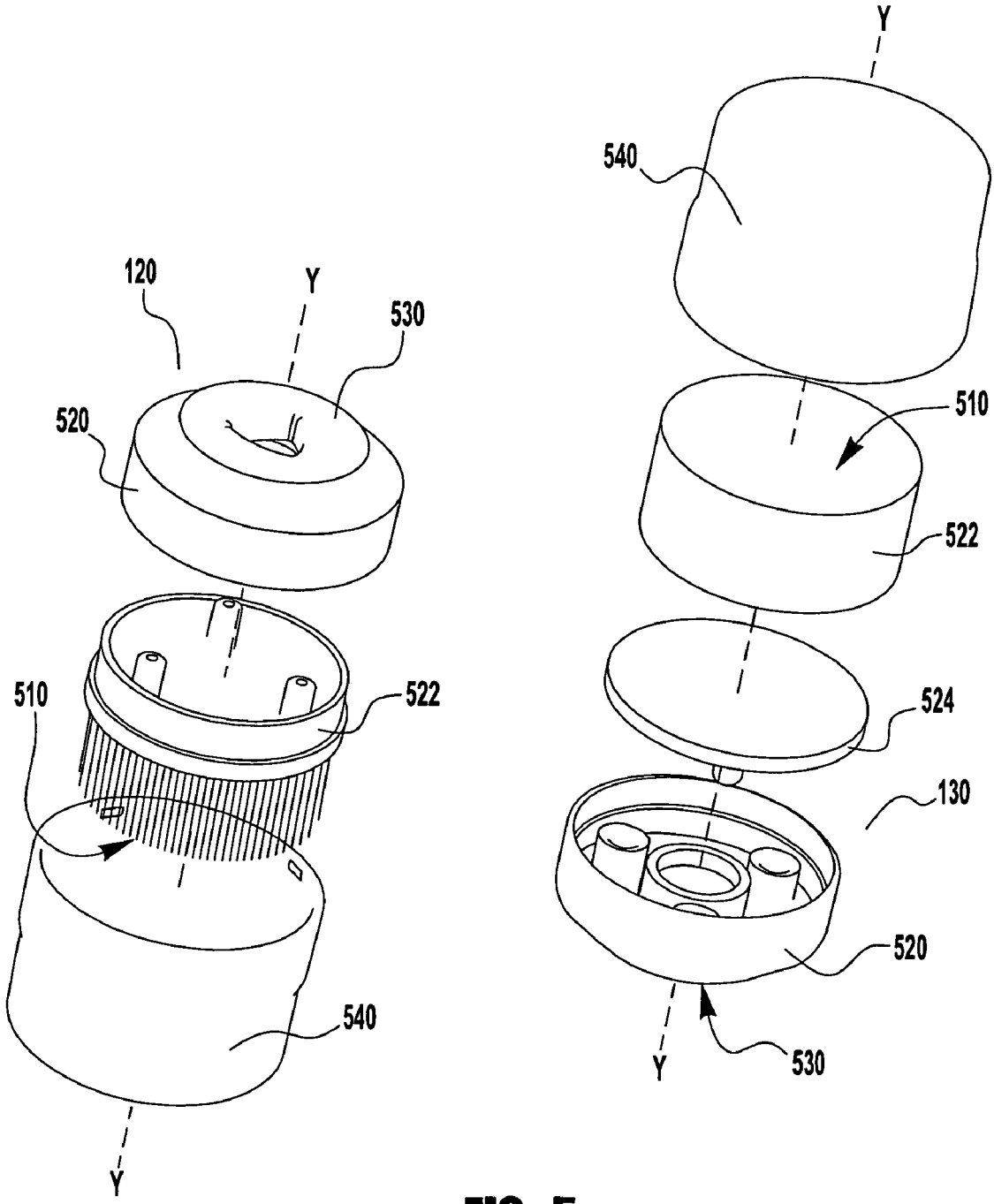
FIG. 5 shows an exploded perspective view of an embodiment of two heads which are attachable to the shoe care apparatus of FIG. 1.

Referring to FIG. 1, representative heads according to one embodiment of the invention include a first head 120 and a second head 130. The first head 120 is shown as a brush, and the second head 130 is shown as a pad. Referring to FIG. 5, each head has a generally planar face 510 that is parallel to the axis X and perpendicular to the shank axis Y. While the heads of the illustrated embodiment have disc shaped, or circular faces, in alternate embodiments, head faces 510 may be square, triangular, or oval, or may have a shape that is hemispherical, or conical. In some embodiments, a head face 510 may also comprise a lip, skirt, or edge that extends from or is continuous with the generally planar face, and when engaged with a shank, is generally parallel to the shank axis (not shown).

As shown in the illustrated embodiment, heads include a base 520 that has on one side a polishing implement 522 intended for contact with an object to be polished, and has on the other side a means for engagement with a corresponding shank. According to the depicted embodiment, the head base 520 has a generally round shape and has a diameter that generally defines the diameter of the head face 510. According to the illustrated embodiment, the portion of the head base 520 that is adapted for engagement with a corresponding shank is generally sloped and terminates in an engagement face 530 that is generally planar and circular, and has a diameter that is smaller than the diameter of the head face 510. In alternate embodiments which are not shown, the base 520 may have a different shape, and may have an engagement face 530 that is of a different shape, and may be larger or smaller than the size of the head face 510. For example, the base may be generally cylindrical, and have an engagement face that is the same diameter as the head face 520. In yet other embodiments, the base may be conical or cubical in shape, or may have another shape suitable for permitting attachment of a polishing implement on one side and engagement with a shank on the other side. In some embodiments, the base may comprise additional components for securing the polish implement to the base, such as, for example, a platform plate 524 for supporting a polish implement 522. Head components are engaged using any of a variety of means, such at interlocking tabs and slots, screws, glue, threads, and the like.

According to the invention, the low-speed shank is adapted for engagement with heads that are used for applying treatment agents such as polish and cleaning solutions. Accordingly, applicator heads are adapted for absorbing or retaining treatment agents, and are in the form of pads and brushes. Such heads are constructed with one or more natural or synthetic materials, such as cotton, natural or synthetic sponge, foam, wool, or other materials. Applicator heads may be relatively thin, or may be thick and lofty. They may be preloaded with treatment agents. In such embodiments, the applicator heads may contain one or more chambers within the body of the head, which chambers are adapted to be filled with one or more treatment agents. Applicator heads may also be textured, or may be dense brushes, that are useful for scrubbing or otherwise cleaning the surface of an object prior to or during application of a treatment agent.

In some embodiments, a head comprises a protective cap 540 that is useful for enclosing the heads when not in use. The protective cap 540 serves to protect the polish implement 522 of the head from becoming soiled or damaged, and also prevents the polish implement 522 from becoming dry and brittle between use. The protective cap 540 may be fashioned from plastic, metal or other resilient material, and are adapted to be removably attached by an engagement means, and to completely cover the polish implement 522 of a head.

The surface area of each head face 510 ranges from 0.1 square inches to 20 square inches. According to the invention, embodiments of heads having a generally circular shape have diameters from 0.2 inches to 5 inches. In other embodiments, generally circular heads have diameters from 0.5 inches to 2 inches. Accordingly, a generally circular head has a diameter of 0.5, 0.6, 0.7, 0.8, 0.9, 1, 1.1, 1.2, 1.3, 1.4, 1.5, 1.6, 1.7, 18, 1.9 or 2 inches. In some embodiments, a polish head having a generally circular shape has a diameter of 0.5, 0.6, 0.7, 0.9, 0.9 or 1 inches, and an applicator head having a generally circular shape has a diameter of 0.5, 1, 1.5 or 2 inches.

According to the invention, the high-speed shank is adapted for engagement with heads that are used for buffing or polishing. Accordingly, polish heads are adapted for achieving a high-shine on the surface of polished objects, and are in the form of pads and brushes. Polish heads are constructed with one or more natural or synthetic materials, such as cotton, wool, chamois, natural hair, such as horse hair, and synthetic bristles. The texture of the construction materials are suitable for finishing the surface of a polished object to a desired shine. Good results have been obtained using natural and synthetic bristles with the shoe care apparatus embodiments described in connection with FIG. 3.

When using the shoe care apparatus 100 of the illustrated embodiment to either apply polish or cleaning agents, or to buff and polish a shoe or other object, the user will often need to apply pressure at the interface between the head and the object. As force is applied to a shank of the shoe care apparatus 100, this force will tend to influence the rate of rotation of the head to which the force, or pressure is being applied by the user. The gear ratio, motor torque and motor output speed all influence, among other things, the torque, or rotational force of a shank. Shank torque in turn influences the effectiveness of use of a head that is attached to a shank. Accordingly, according to the instant invention, the torque of the low-speed shank and its corresponding applicator head is in the range from 300 to 600 MilliNewton Meters. Within this range, a user can apply pressure between the applicator head and the surface of an object without experiencing an appreciable slow-down or stoppage of the rotating head. Likewise, the torque of the high-speed shank is in the range from 50 to 250 MilliNewton Meters. Within this range, a user can apply greater or lesser degrees of pressure to the surface of the object being polished without appreciably altering the speed of rotation of the polishing head, thus ensuring a high-gloss shine to the surface of the object.

In one embodiment of the shoe care apparatus 100, the electric motor 310 operates on 9 volts of power, and generally rotates its output shaft 312 at a rate of 17,000 revolutions per minute, with a torque in the range of 4 to 25 MilliNewton Meters when no load is placed on the electric motor 310. The head on the high-speed shank is generally circular and has a radius of 0.75 to 1 inch, and the head on the low-speed shank is generally circular had has a radius of 0.5 to 1 inch. In use, the torque of the high-speed head is approximately 114 MilliNewton Meters, and the torque of the low-speed head is approximately 455 MilliNewton Meters. The configuration of the motor of the illustrated embodiment was chosen because good results have been obtained in achieving the desired combination of effectiveness and manufacturing cost.

Each of the shanks 302 and 304 are configured so as to engage with one or more different heads that are used to treat or polish objects. In some embodiments, engagement between a head and a shank is achieved by insertion of the shank into a recess in a corresponding head, wherein the shape of the first shank and the recess in its corresponding head is different as compared to the shape of the second shank and the recess in its corresponding head. The purpose of this unique keying is to ensure that each shank engages only with corresponding heads, thus preventing the heads from being interchanged between the shanks.

Figure 6:
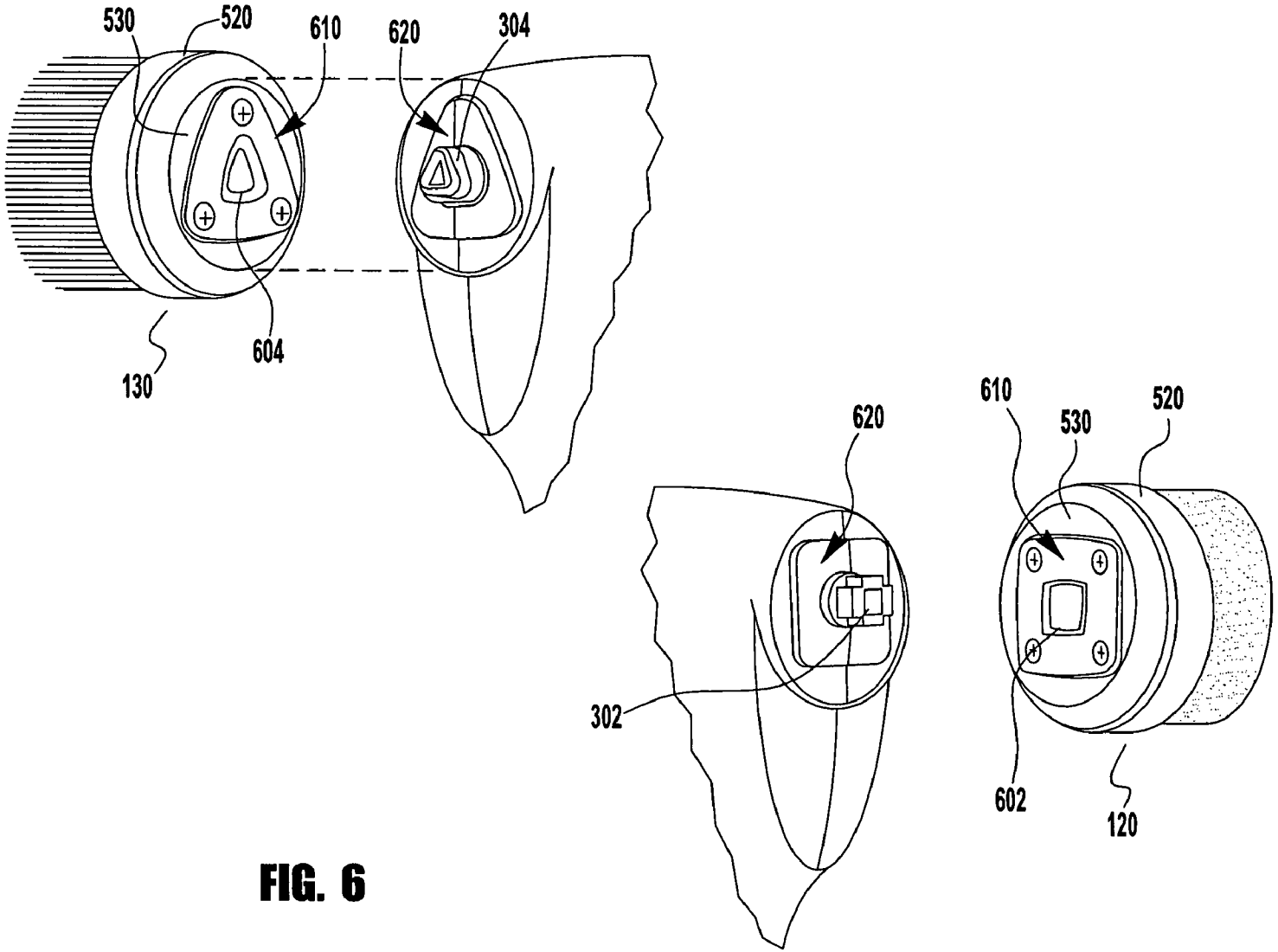
FIG. 6 is a perspective view of the head portion of the shoe care apparatus of FIG. 1, showing the detail of one embodiment of the engagement means between two heads and corresponding shanks situated within the head portion of the shoe care apparatus.

Referring to an embodiment of the shoe care apparatus illustrated in FIG. 3 and FIG. 4, the low-speed shank 302 is uniquely keyed to engage with heads that are configured for low-speed use for the application of polish, cleaning agents, and the like. According to the depicted embodiment of FIG. 6, shank 302 has a square shape defined by four generally planar sides, and the corresponding head. Likewise, the high-speed shank 304 is uniquely keyed to engage with heads that are configured for high-speed use for the polishing and buffing of objects. According to the depicted embodiment of FIG. 6, shank 304 has a triangular shape defined by three generally planar sides. The head 120 which engages with the low-speed shank has a recess 602 set in the head base 520, and the head 130 that engages with the high-speed shank has a recess 604 set in the head base 520. In some embodiments, the engagement face 530 on each of the heads 120 and 130 has a surface feature 610 that corresponds with the shape of the recess 602, such as the shape of a triangle or square. In some embodiments, the housing 110 of the shoe care apparatus 100 comprises a surface feature 620 positioned on the side wall 207 of the head portion 170 of both the base 202 and the cover 202 on each of the respective sides of the head portion 170, wherein the shape of the surface feature 620 on each side of the head portion 170 corresponds respectively with the shape of the shanks 302 and 304. Of course, shapes other than those depicted in FIG. 6 may be used to key the shanks and heads. Likewise, other engagement means not described herein may be used such that each of the shanks 302 and 304 are configured to engage only with certain heads.

The shoe care apparatus 100 includes an activation switch 140. In the illustrated embodiment, the activation switch 140 is a momentary switch, but many different types of switches could be used. In the illustrated embodiment of FIG. 2 and FIG. 3, the momentary switch 140 includes a deformable membrane 260, which acts as a push-button, located within the activation switch opening 208 of the cover 204. When pressed, the deformable membrane 260 contacts an interior switch 240 (that is connected to the electric motor 310 by wiring (not shown)) that completes an electrical circuit and activates the electric motor 310. The interior switch 240 is seated on a switch support compartment 242 within the housing 110. Upon activation by depressing the momentary switch 140, the electric motor 310 runs until the momentary switch 140 is released. However, alternative embodiments may include switches that do not have to be continuously pressed to activate the electric motor 310. The deformable membrane 260 of the activation switch 140 of the illustrated embodiment is formed from rubber and creates a water-resistant seal that protects the electrical components of the shoe care apparatus 100 by preventing water, other fluids, or particulate matter from entering the housing 110. It should be apparent to those skilled in the art that the present invention could include many different types of switches rather than momentary switches, and other embodiments may not include an interior switch 240 or deformable membrane 260.

Referring to FIG. 2, the shoe care apparatus 100 of the illustrated embodiment includes four 1.5 volt AA alkaline batteries 230 that are supported and enclosed within the battery compartment 209 of the housing 110 and covered by the battery cap 150. The batteries are electronically connected with the electric motor 312 and to the activation switch 140 of the shoe care apparatus 100 by wires (not shown) and contacts 272, and power the electric motor 312. Different types and numbers of batteries could be effectively used. Additional power to the shoe care apparatus 100 can be achieved by increasing the number of the voltage of the batteries, or both. By varying the number and/or the voltage of the batteries, the rotational speed and the torque of the electric motor 310 is influenced, and in turn, the rotational speed and the torque of the shanks 302 and 304 is influenced. When determining the number and voltage output of batteries to be included in the shoe care apparatus 100, the effectiveness of the shoe care apparatus 100, the manufacturing cost, and the size of the housing 110 are considered. Of course, alternate means of providing power to the device may be used. For example the shoe care apparatus 100 may be powered externally using alternating or direct current. Accordingly, in alternate embodiments, the shoe care apparatus 100 comprises an alternating current adapter for use with standard U.S. household current, and a power cord having a plug for insertion into standard household electric receptacle. In yet other alternate embodiments, the shoe care apparatus 100 comprises a direct current adapter for converting various voltages of direct current to a fixed voltage, and a power cord having a plug for insertion into a direct current electric receptacle.

According to one embodiment of the invention having the motor and gear configurations described in connection with FIG. 3 and FIG. 4, good results were obtained using six 1.5 V AA batteries because this configuration produces the shank rotational speed and torque to achieve satisfactory treatment and buffing for an acceptable manufacturing cost with the smallest housing size. It should be apparent to those skilled in the art that the present invention could also be powered by other power sources, for example the shoe care apparatus 100 of the present invention could be adapted to be powered by standard household electrical current, or a direct current power sources, such as a vehicle cigarette lighter.

To use the shoe care apparatus 100 of the embodiment illustrated in FIG. 1, the user grasps the housing 110 of the shoe care apparatus 100. If the user intends to apply treatment agents to an object, the user will grip the shoe care apparatus such that the applicator head 130 is on the same side of the user's hand as the user's thumb. To begin application of a treatment agent, such as a colored polish, the user removes the protective cover from the applicator head 130 and the polish head 120, unless the covers are already removed. If the applicator head 130 is not pre-loaded with polish, the user applies a polish of choice to the applicator head 130 maintaining the grip on the shoe care apparatus 100 while contacting a polish container with the applicator head 130. If the applicator head 130 has been pre-loaded with polish, it is not necessary for the user to apply polish.

The user activates the switch to start rotation of the applicator head 130, then contacts the polish-loaded applicator head 130 to the surface of an object to be polished, and while applying light pressure, moves the applicator head 130 over the portions to be polished, in a generally circular pattern. When coverage of the surface to be polished is achieved, the user rotates the shoe care apparatus 100 in her grip so that the polish head 120 is on the same side of the user's hand as the user's thumb. The user then contacts the polish head 120 to the surface of the object, and while applying moderate to heavy pressure, movers the polish head 120 over the portions of the object to be polished, in a generally circular pattern.

Due to the placement and functionality of the activation switch 140, the shoe care apparatus 100 of the illustrated embodiment can be placed in pliable packaging (not shown) that is transparent, and a potential user can press the activation switch 140 and visualize the shoe care apparatus 100 operating while still in its packaging. The shape of the packaging closely mimics the configuration of the shoe care apparatus 100, except the portion of the packaging that houses the blade heads of the shoe care apparatus 100 includes added clearance that allows the heads to rotate within the package without damaging the package. Consequently, a potential user can become associated with the easy operation of the shoe care apparatus 100 while it is still sealed in its packaging. Optionally, the packaging could include a window to allow a potential user to access the activation switch through the packaging.

The embodiments described above are examples of preferred embodiments and are not intended to limit the scope of the claims set forth below. Variations to the inventions described herein, including alternate embodiments not specifically described, are quiet possible and are encompassed by the claims as understood by one of ordinary skill in the art. Indeed, the claimed inventions have their broad and ordinary meaning as set forth below in the claims.

The invention claimed is:

1. A shoe care apparatus comprising:

a housing which contains at least one gear assembly, a first shank and a second shank that are each operatively connected to said at least one gear assembly in said housing to rotate around a common axis of rotation, wherein each of said first and second shanks is driven by said at least one gear assembly to rotate at a different rate of speed relative to the other shank and in the same direction of rotation relative to the common axis of rotation, a first head and a second head mounted on said first shank and said second shank, respectively, and said first and second shanks are disposed such that said first and second heads are disposed at opposing outside portions of the housing.

2. The shoe care apparatus according to claim 1, wherein said first and second shanks rotate simultaneously.

3. The shoe care apparatus of claim 1, wherein the first shank is driven to rotate at a rate of speed that is higher than the rate of speed at which the second shank is driven to rotate.

4. The shoe care apparatus of claim 1, wherein said at least one gear assembly is a planetary gear assembly, a compound gear assembly, or combinations thereof.

5. The shoe care apparatus of claim 1, wherein said first shank and said second shank are both operatively connected to the same gear assembly.

6. The shoe care apparatus of claim 1, wherein the ratio of the rate of rotation of the first shank to the rate of rotation of the second shank is between 1:2 and 1:100.

7. The shoe care apparatus of claim 6, wherein the ratio of the rate of rotation of the first shank to the rate of rotation of the second shank is between 1:3 and 1:5.

8. The shoe care apparatus of claim 1, wherein the rate of rotation of the first shank is between 500 rpm and 2000 rpm.

9. The shoe care apparatus of claim 8, wherein the rate of rotation of the first shank is 1500 rpm.

10. The shoe care apparatus of claim 1, wherein the rate of rotation of the second shank is between 0.001 rpm and 400 rpm.

11. The shoe care apparatus of claim 10, wherein the rate of rotation of the second shank is 200 rpm.

12. The shoe care apparatus of claim 1, wherein the torque of the first shank is between 50 MilliNewton Meters and 250 MilliNewton Meters.

13. The shoe care apparatus of claim 12, wherein the torque of the first shank is 115 MilliNewton Meters.

14. The shoe care apparatus of claim 1, wherein the torque of the second shank is between 300 MilliNewton Meters and 600 MilliNewton Meters.

15. The shoe care apparatus of claim 14, wherein the torque of the second shank is 450 MilliNewton Meters.

16. The shoe care apparatus of claim 1 comprising an electric motor in operative engagement with the at least one gear assembly.

17. The shoe care apparatus of claim 16 comprising a power source for supplying power to the electric motor.

18. The shoe care apparatus of claim 17 wherein the power source comprises at least one battery.

19. The shoe care apparatus of claim 18 wherein the power source comprises:

an alternating current adapter for use with standard U.S. household current; and a power cord having a plug for insertion into standard household electric receptacle.

20. The shoe care apparatus of claim 18 wherein the power source comprises:

a direct current adapter for converting various voltages of direct current to a fixed voltage; and a power cord having a plug for insertion into a direct current electric receptacle.

21. The shoe care apparatus of claim 16 wherein the electric motor produces an output of generally between 10,000 rpm and 25,000 rpm.

22. The shoe care apparatus of claim 21 wherein the electric motor produces an output of generally between 12,000 rpm and 20,000 rpm.

23. The shoe care apparatus of claim 22 wherein the electric motor produces an output of generally 16,000 rpm.

24. The shoe care apparatus of claim 16, wherein the electric motor has a torque between 2 MilliNewton Meters and 25 MilliNewton Meters.

25. The shoe care apparatus of claim 24, wherein the electric motor has a torque of 4 MilliNewton Meters.

26. The shoe care apparatus of claim 16 comprising an activation switch operatively connected to the electric motor for activating the electric motor.

27. The shoe care apparatus of claim 1 wherein the at least one gear assembly and the first and second shanks are contained within the housing, and the housing has a longitudinal axis, and wherein each of said first and second shanks extends outward from the housing along axes of rotation that intersect with the longitudinal axis of the housing.

28. The shoe care apparatus of claim 27, wherein the housing forms an elongated handle portion and a head portion, wherein said first and second shanks are positioned in the head portion, at one end of the elongated handle portion.

29. The shoe care apparatus of claim 27, wherein the axes common axis of rotation of each of the first and second shanks is perpendicular to and intersects the longitudinal axis of the housing.

30. The shoe care apparatus of claim 27, wherein an indented portion adapted to cradle a user's hand is defined within the housing.

31. A head for use with the shoe care apparatus of claim 1, wherein the head has a face that is generally planar, and wherein the shape of the head face is circular, square, triangular, oval, hemispherical, or conical.

32. A head according to claim 31, comprising a protective cap.

33. The shoe care apparatus of claim 1, wherein the rate of rotation of the first shank is between 500 rpm and 2000 rpm, and the rate of rotation of the second shank is between 0.001 rpm and 400 rpm.

34. The shoe care apparatus of claim 33, wherein the rate of rotation of the first shank is 1500 rpm, and the rate of rotation of the second shank is 200 rpm.

35. A shoe care apparatus comprising:

a housing which contains at least one gear assembly, a first shank and a second shank that are each operatively connected to said at least one gear assembly in said housing to be driven to rotate in the same direction of rotation relative to a common axis of rotation, a first head and a second head mounted on said first shank and said second shank, respectively, said first and second shanks are disposed such that said first and second heads are disposed at opposing outside portions of the housing, wherein said first and second shanks are configured such that said first head cannot be mounted on said second shank and wherein said second head cannot be mounted on said first shank.

36. The shoe care apparatus according to claim 35, wherein said first and second shanks rotate simultaneously.

37. The shoe care apparatus of claim 35, wherein engagement between the first shank and the first head is achieved by insertion of the first shank into a recess in the first head, and wherein engagement between the second shank and the second head is achieved by insertion of the second shank into a recess in the second head, wherein the shape of the first shank is different as compared to the shape of the second shank, and wherein the shape of the recess in the first head is different than the shape of the recess in the second head.

* * * * *